United States Patent [19]

Younger et al.

[11] Patent Number: 4,544,203

[45] Date of Patent: Oct. 1, 1985

[54] FOLDABLE HEAD REST

[76] Inventors: Steven K. Younger, 32804 42nd Ave. SW., Federal Way, Wash. 98502; Rudolf A. Fiedelak, 1722 Austin Rd., NE., Tacoma, Wash. 98422

[21] Appl. No.: 659,693

[22] Filed: Oct. 11, 1984

[51] Int. Cl.[4] ..... A47C 7/36; A47C 4/38

[52] U.S. Cl. ..... 297/391; 108/118; 248/118; 248/164; 297/45; 297/439; 403/117; 403/348

[58] Field of Search ..... 297/1, 3, 45, 56, 391, 297/438, 439; 248/118, 164; 108/118; 403/117, 348

[56] References Cited

U.S. PATENT DOCUMENTS

| | | | |
|---|---|---|---|
| 59,403 | 11/1866 | Jouett | 297/1 |
| 116,164 | 6/1871 | Daly | 108/118 X |
| D. 156,664 | 12/1949 | Richards | D15/8 |
| 226,453 | 4/1880 | Kelly | 403/348 X |
| 278,361 | 5/1983 | Prescott . | |
| 407,776 | 7/1889 | Harrison . | |
| 1,209,679 | 12/1916 | Decker | 108/118 X |
| 1,921,984 | 8/1933 | Moore | 5/337 |
| 2,197,343 | 4/1940 | Marx | 5/37 |
| 2,502,752 | 4/1950 | Richards | 155/177 |
| 2,563,700 | 8/1951 | Wolf | 5/337 |
| 2,574,590 | 11/1951 | Ross | 5/337 |
| 2,697,581 | 12/1954 | Ray | 403/348 X |
| 3,002,201 | 10/1961 | Nelson et al. | 5/337 |
| 4,295,571 | 10/1981 | Meyer | 248/164 X |

FOREIGN PATENT DOCUMENTS

| | | | |
|---|---|---|---|
| 416676 | 12/1946 | Italy | 248/164 |

*Primary Examiner*—William E. Lyddane
*Assistant Examiner*—Peter R. Brown
*Attorney, Agent, or Firm*—Roy E. Mattern, Jr.

[57] ABSTRACT

The present invention concerns a foldable head rest which provides elevated support for a person's head while lying in the prone position at the beach or other leisure place, for example. The head rest may be easily carried in a folded flat configuration in one's luggage or hand and quickly unfolded for use at the beach.

The head rest broadly comprises a pair of rectangular frames including an interior and exterior frame each having two seats of two offset but parallel leg portions. Cross members join the opposite leg portions of each frame at their otherwise free ends. Fabric panels are secured to the respective cross members of the opposite frames including a top panel which provides direct support for the head and a bottom panel which supportively contacts the sand or ground to prevent the head rest from sinking into the sand or ground.

Each set of leg portions of each frame are formed at their midsections with a central hub. The adjoining hubs have a protruding hinge shaft and receiving hole on the exterior and interior frames respectively, for interlocking the frames and providing pivotal movement therebetween.

3 Claims, 9 Drawing Figures

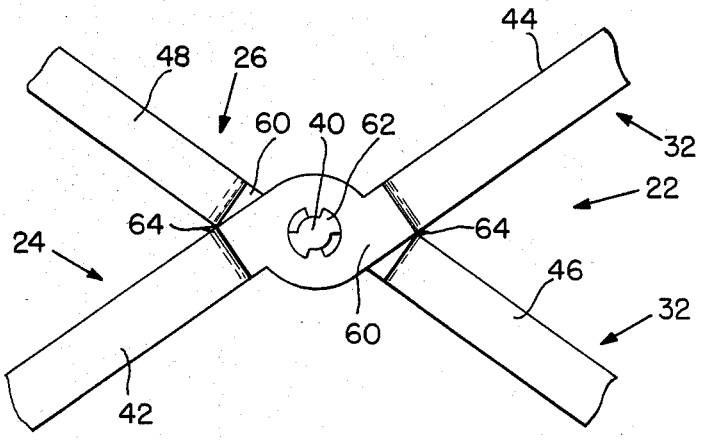
FIG. 4
FIG. 5
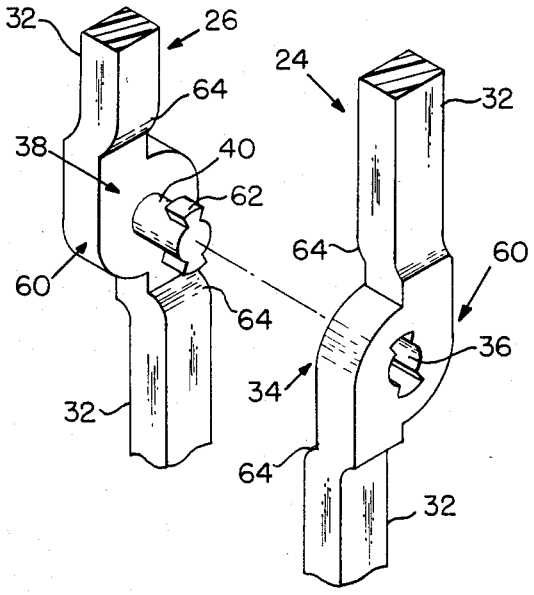
FIG. 7
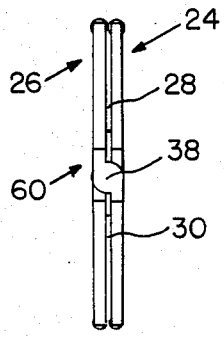
FIG. 8
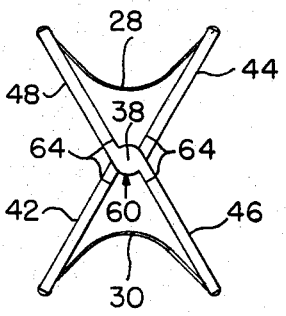
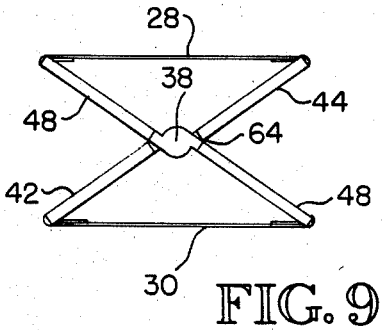
FIG. 9
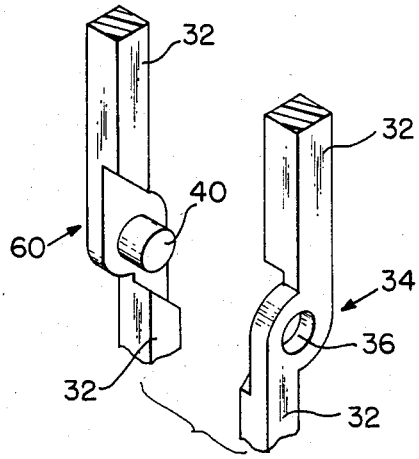
FIG. 6

FOLDABLE HEAD REST

BACKGROUND OF THE INVENTION

A variety of compact support apparatuses, including head, limb and buttock rests, have been developed for leisurely relaxation. In particular, a number of head rests have been designed to be foldably compact during nonuse.

Richards, U.S. Pat. No. 2,502,752, has developed a head and limb rest which comprises a pair of rectangular frames and a pair of top and bottom fabric slings. The frames are unfolded to angularly extend apart. The pivotal rotation of the frames is restricted by a pair of break joint braces, oppositely secured to the respective frames. The break joint type braces lock in position when the frame is fully unfolded to act as a support feature for the head and limb rest.

Nelson et al., U.S. Pat. No. 3,002,201, has developed a head rest utilizing a pair of rectangular metal frames. Instead of utilizing a hinging means for the two frames, a biasing elastic band is secured between the ends of the respective upper and lower frame members to force the frames to unfold and which also keeps the frames joined.

Similar devices have been made for head and limb support which utilize rivets or nuts and bolts to serve as a hinging and pivoting means for the frames of the head rest. Marks, U.S. Pat. No. 2,197,343 has developed such a foldable head rest comprising two polygonal frames pivotally secured at their central narrower portion by a rivet or screw. Other head rests including those of Richards and Ross, U.S. Pat. No. 2,574,590 comprise additional hinging hardware or pivotal rivets and the like to secure multiple frames together.

Among the various head rests developed, only Richards provides for a locking means to prevent further expansion or unfolding of the head rest frames. With regard to most of the other devices, the supportive fabric panels provide the limitation or restriction of rotation of the frame members when the panels are tautly extended in the fully open position. This feature is shown on the head rests of Nelson et al. and Marks.

Recent developments in composites and plastics have provided for a lighter weight molded plastic rectangular frame in the present head rest invention which combines strength and resilient flexibility. Integrally formed hinging components within the frame members eliminate pivotally connecting screws and rivets as well. The frame members of the present invention incorporate integral stops to restrict unfolding and rotation of the frames and add support to the head rest during use.

SUMMARY OF THE INVENTION

A foldable head rest is used preferably for supporting a person's head while in the prone position, at the beach, for example or lying on the floor reading or watching television. A pair of rectangular frames and their attached supportive rectangular fabric panels comprise the head rest which may be easily carried in a flat, folded configuration in one's luggage or hand and quickly unfolded and set on a selected horizontal surface at a suitable leisure location for use. The head rest may also be used to support the head while in the sitting position or even to support a young infant or child as a seat. Other uses include providing an elevated platform to temporarily store wallets or glasses off of the sand while at the beach.

Internal and external rectangular frames of the head rest each comprise two sets of two offset but parallel leg portions whereby each set is tangent above and below, respectively and integrally formed with a central hub. Pivotal connection of the frames is accomplished by insertion of hinge shafts, which depend inwardly from the central hubs of the external frame, through respective centered holes in the central hubs of the internal frames.

To prevent the frames from being laterally separated while the head rest is in the open position, protruding lobes are secured to the ends of the hinge shafts. In key and keyhole like arrangement, the hinge shafts are rotated within the centered holes so that the lobes function to lock the hubs together thereby preventing removal of the hinge shafts from the centered holes other than when the head rest is in the closed or folded position.

Multitransitional portions of the frames are comprised of the central hubs and extensions depending therefrom. The multitransitional portions provide pivotal hinging portions of the head rest as well as a transitional surface for the rotation of the frames.

Stops are integrally formed with the offset abutment of the leg portions with the multitransitional portions. Further rotation of the frames is restricted upon the engagement of the stops of the interior frame with the exterior frame.

The fabric panels, preferably made of nylon, are stretched to a horizontal position when open, whereby the top panel provides direct support for the head and the bottom panel contacts the ground, such as beach sand, providing enlarged surface area to prevent the head chair from sinking into the sand.

The rectangular frames are molded with integral hubs, including their respective hinge shafts and centered holes, as well as the stops. The molded components of the frames makes unnecessary additional hinge connecting rivets or screws and braces or support components to reinforce and restrict rotation of the frames.

FIG. is a perspective view of the head rest in the fully opened position including a portion of the top fabric panel cut away to show the cross member.

Figure 3:
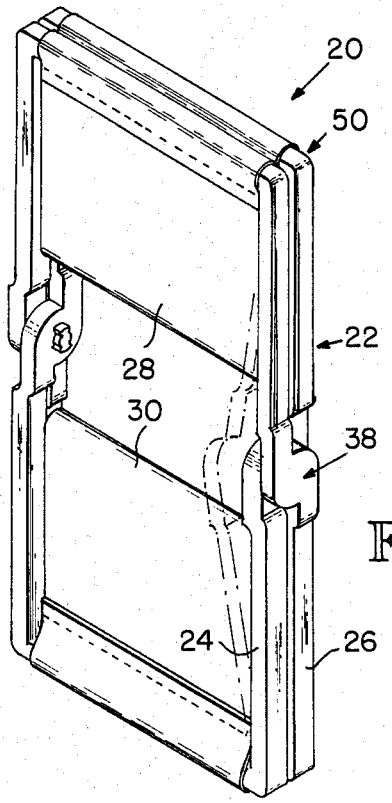

FIG. 3 illustrates the head rest in the closed or folded position. Phantom lines show the relocation of the frames as the head rest begins to unfold.

FIG. 4 is an enlarged sectional view of one side of the head rest showing the multitransitional portion and central hub of the exterior frame as it is hinged with the interior frame. The hinge shaft is insertably locked within the centered hole of the central hubs.

FIG. 5 is a perspective sectional view of the interior frame multitransitional portion and the exterior frame multitransitional portion depicting the alignment of the hinge shaft with the centered hole for insertion and removal while the head rest is in the folded position.

FIG. 6 is a perspective sectional view of an alternative embodiment of the multitransitional portion including non keyhole shaped hinge shafts and centered holes.

FIGS. 7 through 9 are side views illustrating the head rest from a fully closed and folded position progressively through to an unfolded and then fully opened extended position.

DESCRIPTION OF THE PREFERRED EMBODIMENTS

Introduction

The present invention pertains to a foldable portable head rest 20 to be used to support the head of a person while in the prone or even sitting position. The head rest 20 may be compactly folded for carrying inside one's luggage or in one's hand, and quickly unfolded for use at the beach, for example, or while watching television or reading.

Figure 1:
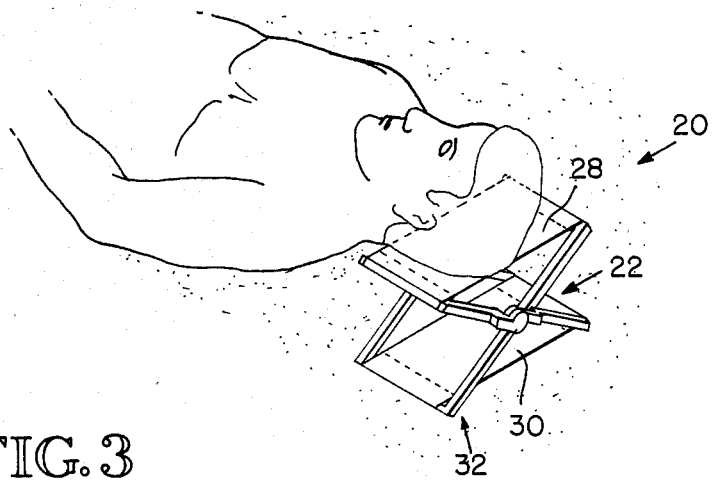
FIG. 1 is an environmental view showing the head rest in use.

The head rest 20 broadly comprises a foldable frame subassembly 22, further comprising a narrower interior rectangular frame 24 and a wider exterior rectangular frame 26, and a top rectangular fabric panel 28 and bottom rectangular fabric panel 30, each being secured between the ends of the respective interior 24 and exterior 26 frames. In the closed position, the headrest 20 is folded flat with the substantially symmetrical interior 24 and exterior 26 frames abutting one another. The fabric panels 28 and 30 are folded, extending inwardly to be stored within the flat rectangular shaped headrest 20. In preparation for use at the beach, for example, the frames are separated diagonally until stops 64 of the interior 24 and exterior 26 frames become engaged and the respective fabric panels are stretched taut to a level position as shown in FIGS. 1 and 2.

The Foldable Frame Subassembly of the Head Rest

Figure 2:
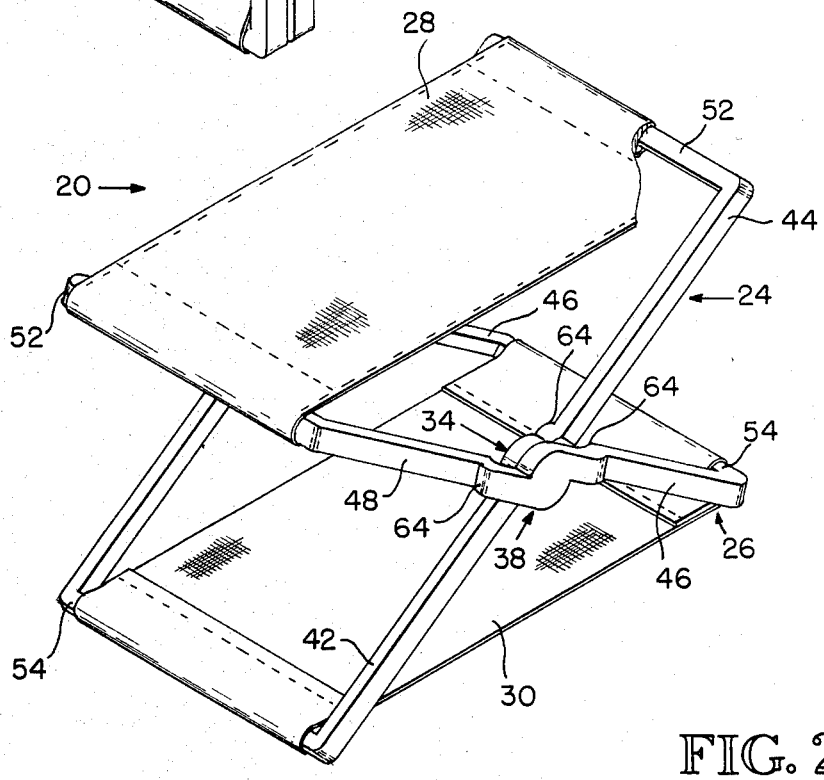

As shown in FIGS. 2 and 3, the frame subassembly 22 comprises a pair of rectangular frames, including an interior rectangular frame 24 and an exterior rectangular frame 26. The sides of the interior frame 24 further comprise two sets of two parallel but offset leg portions 32. The leg portions on each side of the interior frame 24 are tangent respectively, above and below an integrally formed central inner hub 34, each hub having a centered hole 36. The exterior frame 26 also includes two sets of two parallel but offset leg portions 32. The leg portions 32 on each side of the exterior frame 26 are likewise tangent above and below respectively an integrally formed central outer hub 38, each outer hub having a centered partial hinge shaft 40 extending inwardly from the middle of the central outer hub 38 as shown in FIG. 5. During use, the frames are hingedly secured at the central hubs, which are located equidistant between the ends of each set of leg portions 32.

As a practical matter, the head rest may be used with either fabric panel being positioned on top to support the head. For illustrative purposes, however, it will be shown in FIGS. 2–4 and 7–9 that the interior frame 24 further comprises lower interior legs 42 and upper interior legs 44 while the exterior frame 26 comprises lower exterior legs 46 and upper exterior legs 48.

Cross members 50 join the leg portions at the upper and lower end of each frame. The upper cross members 52 of both the interior 24 and exterior 26 frames provide the supporting member and mounting means for the top fabric panel 28 as shown in FIG. 2.

Lower cross members 54 of both the interior and exterior frames provide support at the base of the head rest and are used to secure the ends of the bottom fabric panel 30.

While opening the headrest 20, the frames separate and extend angularly into a criss cross arrangement. Viewing the headrest in the fully open position on a horizontal surface, the lower interior 42 and lower exterior 46 leg portions appear as being in relative tangentially planar position above their inclusive central hubs as shown in FIGS. 4 and 7–9. The upper interior 44 and upper exterior 48 leg portions, in contrast, lie in relative tangentially planar position below the central hubs. Upon closing the head rest to the folded position, the frames come into alignment and abut one another as shown in FIGS. 3 and 9.

The Multi Transitional Portions Provide for Hinged Connection and Restrictive Pivotal Rotation of the Interior and Exterior Rectangular Frames Each central hub and its respective tangential end portions of the set of leg portions further comprise a multi transitional portion 60, located midway along each side of each rectangular frame as shown in FIGS. 1–3 and 7–9 of the drawings. The multi transitional portions 60 are offset with respect to the leg portions 32 and serve as a hinging and pivotal interface and guiding surface for the rotation of the interior 24 and exterior 26 frames as the headrest 20 is opened and closed.

The rectangular frames are secured together at their multi-transitional portions by the insertion of the hinged shafts 40 of the outer central hubs 38 into the centered holes 36 of the inner hubs 34 as shown in FIG. 5.

In the preferred embodiment of the head rest, the centered holes 36 of the inner hubs 34 are arranged in a keyhole shape while the hinge shafts 40 of the outer hubs 38 are key shaped in appearance, having projecting lobes 62 secured to the ends of the hinge shafts 40 as shown in FIGS. 4 and 5. The interior 24 and exterior 26 frames are adapted to be assembled or disassembled only when the head rest 20 is in the folded position. As shown in FIGS. 3 and 5, while the two rectangular frames are positioned in parallel alignment, the hinge shafts may be inserted through the key shaped centered holes whereby the protruding lobes 62 extend inwardly beyond the interior surfaces of the inner central hubs 34.

Upon unfolding the head rest, the interior 24 and exterior 26 frames rotate from their parallel position to extend diagonally to the fully opened position as shown in FIGS. 7, 8 and 9. The hinge shafts 40 are thus rotated within the centered holes 36 whereby the projecting lobes 62 provide a locking means to prevent the frames from being laterally separated while the head rest is in the open or unfolded position.

Offset Leg Portions and Multi Transitional Portions Define Stops

The offset position and abutment of the leg portions 32 with their integral multi transitional portions 60 define stops 64 as shown in FIGS. 2 to 9. It may be seen that the interior frame leg portions protrude outwardly in an offset manner from the multi transitional portions 60 of the interior frames 24. The resulting protruding abutment of the leg portion 32 with the multi transitional portion 60 forms a stop 64. In a similar fashion, stops 64 are formed by the inward protruding leg portions of the exterior frame 26 at the point of abutment with the multi transitional portions 60.

The inwardly offset leg portions of the external frame 26 and outwardly offset leg portions of the internal frame 24 result in their relative overlapping positions, thereby aligning the leg portions parallel to one another as shown in FIGS. 3 and 9. With the head rest 20 in the closed position, the frames are aligned whereby cross members 50 and leg portions 32 of the interior rectangular frame 24 abut the cross members 50 and leg portions 32 of the exterior frame 26. During opening of the head rest 20, leg portions 32 will continue to rotate until the stops 64 of the upper interior 44 and exterior 48 leg portions engage the stops 64 of the lower interior 42 and exterior 46 leg portions respectively as shown in FIGS. 2 and 9. With the head rest 20 now in a fully opened position, the engaged stops 64 prevent further rotation of the frames as well as provide reinforced strength to the frame subassembly 22 during use of the head rest to support the head.

Top and Bottom Rectangular Fabric Panels of the Head Rest

Rectangular fabric panels 29 and 30 are secured to the top and bottom of the head rest respectively and may be interchangeably reversed to provide the support surface for the head. The panels are preferably made with nylon to prevent tearing or stretching during use.

As shown in FIGS. 1 and 2, the panels are secured to opposite interior 24 and exterior 26 frame cross members respectively whereby the top panel 28 is secured to the upper interior and upper exterior cross members 52 while the bottom panel 30 is secured to the lower interior and lower exterior cross members 54. The ends of each panel are folded around the respective cross member and secured, such as by machine sewing. The width of each panel is preferably equal to the length of a cross member 50.

During use of the head rest 20, the top fabric panel 28 provides direct support for the head while the bottom panel 30 contacts the floor or ground, such as beach sand. The bottom panel 30 provides a large surface area supporting the headrest on soft ground such as sand. The lower portions of the frames are thereby prevented from sinking into the sand or soft ground. Downward forces applied by the weight of the head on the frame subassembly 22 are generally resisted by the stops 64 which prevent further downward rotation of the upper leg portions as well as further upward rotation of the lower leg portions. Top 28 and bottom 30 panels, however, provide some resistance and rotational limitations upon the frames and additional support for their respective upper and lower portions of the frame subassembly when the panels are fully stretched in the open position.

When the head rest is closed, each fabric panel folds upon itself to extend inwardly and be stored within the frame subassembly 22 during non use as shown in FIG. 3.

When the head rest is completely unfolded, the fabric panels are preferably of sufficient length to permit full extension of the rectangular frames and engagement of the stops. At this point, the fabric panels should also be stretched tautly so as to provide adequate support for the head.

Further considerations

The primary purpose of the headrest 20 is to provide support to a person's head while in the reclining position. Alternatively, a small infant might also be supported in the sitting position on the headrest.

In this regard during development of the headrest, it was determined that a high strength plastic and/or a composite material would be required for the frame subassembly to allow for resiliency as well as durability of the head rest during use. Materials such as polyurethane or ABS plastic are suitable for use in the interior 24 and exterior 26 frames. The headrest 20 may also serve as a small table or elevated support for small items such as wallets or eyeglasses. This may be particularly useful at the beach where such items may be subject to damage by being left in the sand.

To reduce manufacturing costs, an alternative hinging means would eliminate the locking feature of the projecting lobes 62 and provide for cylindrically shaped hinge shafts 40 on the outer hubs 38.

We claim:

1. A foldable headrest having a first opened and second folded position comprising:

(a) a first molded integral one piece rectangular frame having upper and lower parallel ends and connecting parallel side legs, (b) a second molded integral one piece rectangular frame having upper and lower parallel ends and connecting parallel side legs, (c) said first and said second frames having substantially equal length, (d) said parallel side legs of said first frame having upper, lower and central portions, (e) said parallel side legs of said second frame having upper, lower and central portions, (f) said upper and lower portions of said parallel side legs of said first frame being spaced apart from each other substantially the same distance as said upper and lower portions of said parallel side legs of said second frame are spaced from each other, (g) said central portions of said parallel legs of said first frame being spaced apart a distance greater than said upper and lower portions of said parallel legs of said first frame, (h) said central portions of said parallel legs of said second frame having at least a portion thereof being spaced apart a shorter distance than at least a portion of said upper and lower portions of said parallel legs of said second frame, (i) said central portion of each of said parallel legs of said first frame having an inwardly projecting key integrally molded therewith, (j) said central portion of each of said parallel legs of said second frame having a cooperating opening therethrough for receiving a respective cooperating key of said first frame, (k) each of said frames being resiliently flexible a distance sufficient for said respective inwardly projecting keys of said first frame to be engaged with and disengaged from said respective openings of said second frame by bowing of said first and second frames outwardly with respect to each other, (l) said upper portions of said parallel legs of said first and second frames being offset laterally from said lower portions of said parallel legs of said first and second frames, (m) each of said central portions of said legs of said first and second frames having short laterally spaced extensions and a central hub portion, (n) said laterally spaced extensions being tangentially arranged on their respective hub portions, (o) stop connecting means on each of said laterally spaced extensions of said central portion connected to their respective upper and lower leg portions for limiting the travel of said frames when in opened and closed positions, (p) a first fabric panel having ends, one end being connected to said first frame upper end and the other end connected to said second frame upper end, (q) a second fabric panel having ends, one end being connected to said first frame lower end and the other end connected to said second frame lower end, and (r) said panels being of a length so that when said frames are in said opened position, said panels will be substantially taut.

2. A foldable headrest as in claim 1, wherein:

(a) said keys of said first frame include means allowing disengagement of said keys from said respective openings of said second frame only when said headrest is in said folded position and preventing disengagement at all other times.

3. A foldable headrest as in claim 2, wherein:

(a) said means allowing disengagement includes key projections extending parallel to said side legs of said first frame, and (b) said openings being keyhole shaped so as to be aligned with and to receive said projections only when said headrest is in said folded position.

* * * * *